US007670230B2

(12) United States Patent
Hsu

(10) Patent No.: US 7,670,230 B2
(45) Date of Patent: Mar. 2, 2010

(54) TRANSMISSION MECHANISM FOR BALANCE TRAINING APPARATUS

(76) Inventor: Pet Chent Hsu, 5F, No.607-1, Sinshu Rd., Sinjhuang, Taipei County (TW)

( * ) Notice: Subject to any disclaimer, the term of this patent is extended or adjusted under 35 U.S.C. 154(b) by 694 days.

(21) Appl. No.: 11/637,949

(22) Filed: Dec. 13, 2006

(65) Prior Publication Data

US 2008/0146357 A1 Jun. 19, 2008

(51) Int. Cl.
*A63G 31/06* (2006.01)
*A63G 31/00* (2006.01)

(52) U.S. Cl. ..... 472/58; 472/96; 434/247; 482/51

(58) Field of Classification Search ..... 472/58, 472/59, 95–97, 100, 101, 130, 135; 434/247, 434/29, 55; 482/51
See application file for complete search history.

(56) References Cited

U.S. PATENT DOCUMENTS 2,915,311 A * 12/1959 Delano ..... 472/97
3,997,979 A * 12/1976 Turner ..... 472/29
4,470,373 A * 9/1984 Kesler ..... 119/427
5,085,425 A * 2/1992 Collins et al. ..... 472/97
5,180,338 A * 1/1993 Pinto ..... 472/96
5,513,990 A * 5/1996 Gluck ..... 434/58
5,531,645 A * 7/1996 Collins ..... 472/97
6,210,286 B1 * 4/2001 Ohara et al. ..... 472/97
6,616,456 B1 * 9/2003 Nalty et al. ..... 434/247
6,808,458 B1 * 10/2004 Jung ..... 472/97
6,964,614 B1 * 11/2005 Tsai ..... 472/58
7,070,415 B2 * 7/2006 Hojo et al. ..... 434/247
7,104,927 B2 * 9/2006 Tsai ..... 482/51
7,121,831 B2 * 10/2006 Hojo et al. ..... 434/247
7,338,413 B2 * 3/2008 Nakanishi ..... 482/51
7,347,806 B2 * 3/2008 Nakano et al. ..... 482/51

* cited by examiner

*Primary Examiner*—Kien T Nguyen

(57) ABSTRACT

A balance training apparatus includes a base and a driving device is connected to the base so as to drive a seat portion in different axes. The driving device has a power source, a swing portion, an active portion driven by the power source and a passive portion which is driven by the active portion. The active portion has a first axle which is driven by the power source of the driving device and cooperated with two eccentric wheels. The passive portion has a second axle which includes a straight section and two crank portions are connected to two ends of the straight section. The two distal ends of the two crank portions are rotatably engaged with the first and second blocks on the base. The active and passive portions drive the seat portion to simulate a horse-riding motion.

9 Claims, 9 Drawing Sheets

TRANSMISSION MECHANISM FOR BALANCE TRAINING APPARATUS

FIELD OF THE INVENTION

The present invention relates to a balance training apparatus, and more particularly, to a transmission mechanism for the balance training apparatus and the transmission mechanism involves less parts and simple structure.

BACKGROUND OF THE INVENTION

A conventional balance training apparatus known to applicant is disclosed in U.S. Pat. No. 7,070,415 which provides the user with three-axis exercising mode so as to improve the user's balance function. However, the conventional balance training apparatus includes a complicated link system which has so many joints and the joints generate significant noise during use. Besides, the complicated structure also means a higher manufacturing cost.

The present invention intends to provide a balance training apparatus which has less number of parts and less noise is generated.

SUMMARY OF THE INVENTION

The present invention relates to a balance training apparatus which comprises a base with two first blocks and two second blocks which are respectively mounted on the two first blocks. A driving device includes a power source, a swing portion, an active portion driven by the power source and a passive portion which is driven by the active portion. A seat portion is connected to the swing portion which has two first recesses and two second recesses. Two first support frames each have a third recess which is located corresponding to respective one of the two first recesses, and two second support frames each have a fourth recess which is located corresponding to respective one of the two second recesses. The active portion and the passive portion are respectively engaged with the first and second support frames.

The active portion has a first axle which extends through two respective through holes of two eccentric wheels and is driven by the power source. The two eccentric wheels are engaged with spaces enclosed by the first and second recesses and the third and fourth recesses. The active portion is moved about the first axle in an oval path. The passive portion has a second axle which includes a straight section and two bearing are mounted to the straight section so that the straight section is rotatably engaged between the first and second recesses of the swing portion and the third and fourth recesses of the first and second support frames. Two crank portions are connected to two ends of the straight section of the second axle and two distal ends of the two crank portions are rotatably engaged with the first and second blocks.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
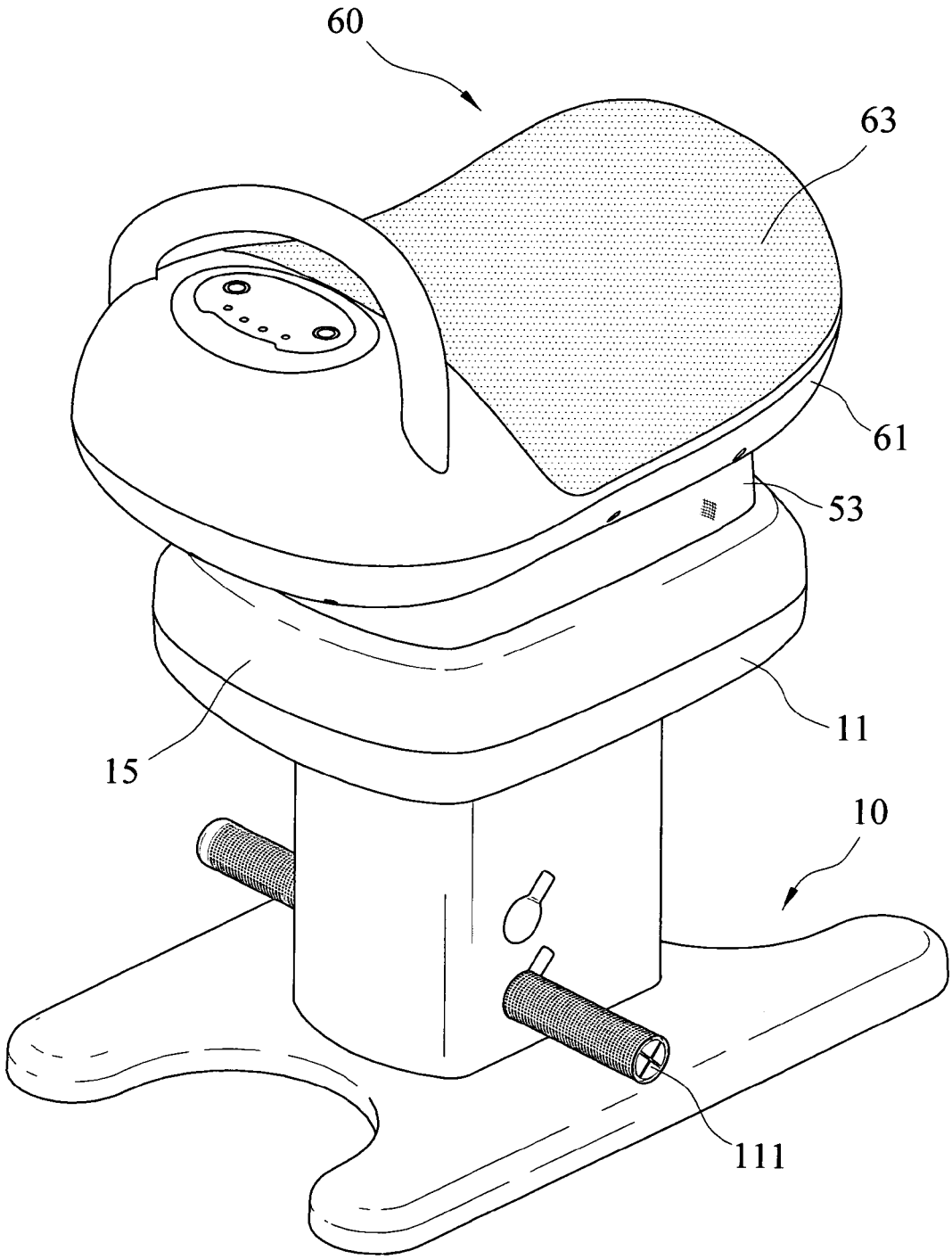
FIG. 1 is a perspective view to show the balance training apparatus of the present invention.
Figure 2:
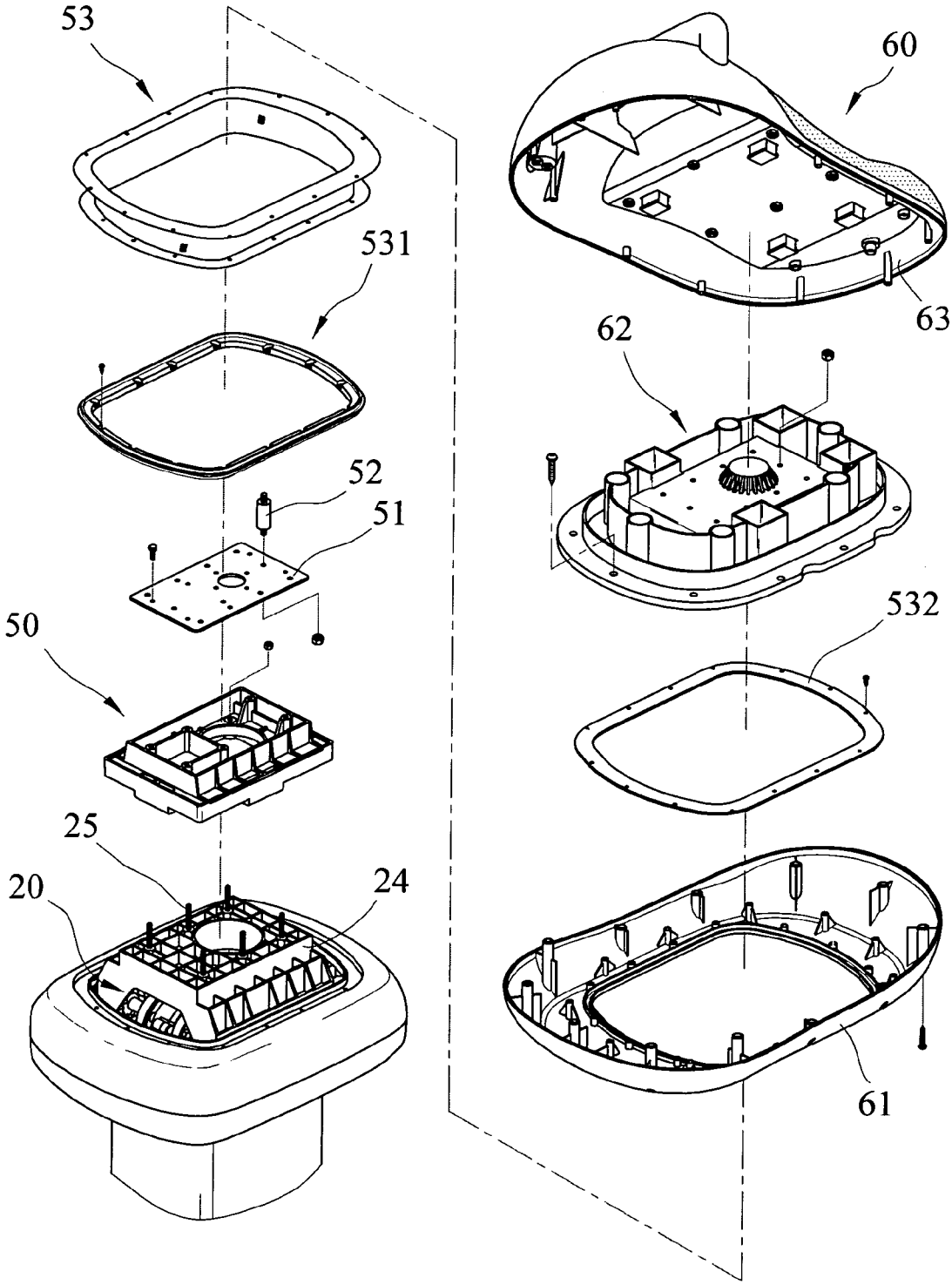
FIG. 2 is an exploded view to show the balance training apparatus of the present invention.
Figure 3:
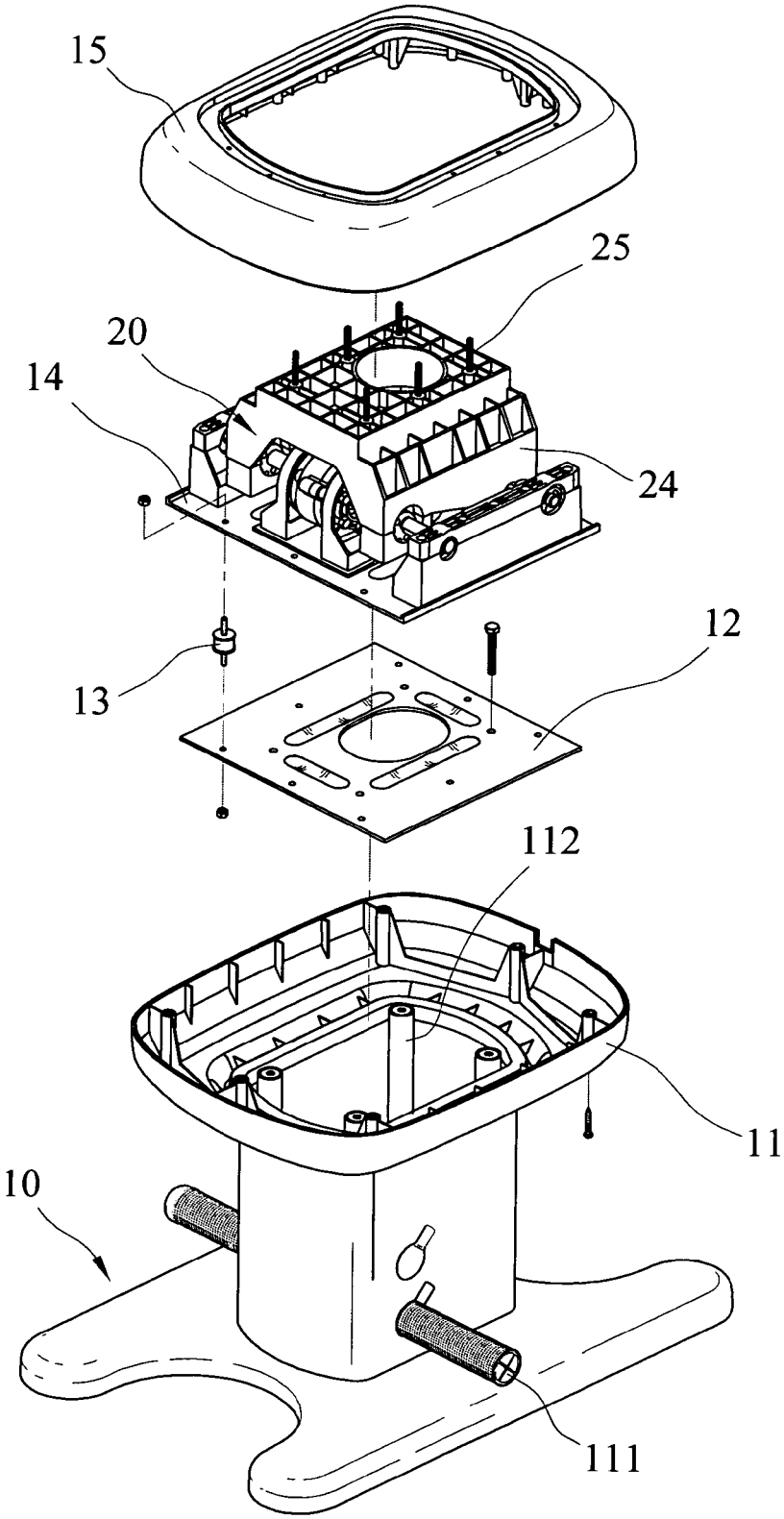
FIG. 3 is an exploded view to show the base and the driving device of the balance training apparatus of the present invention.
Figure 4:
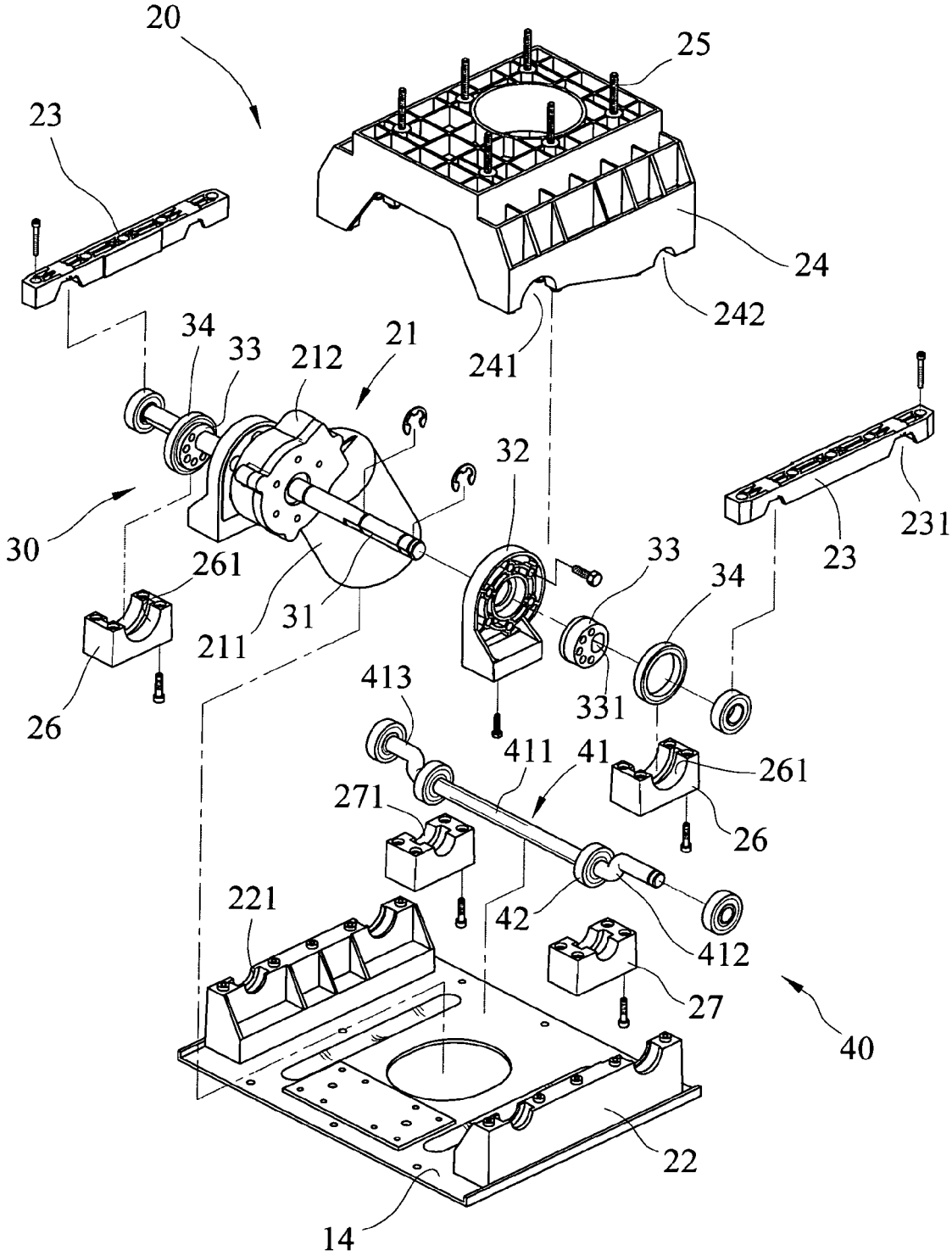
FIG. 4 is an exploded view to show the driving device of the balance training apparatus of the present invention.
Figure 5:
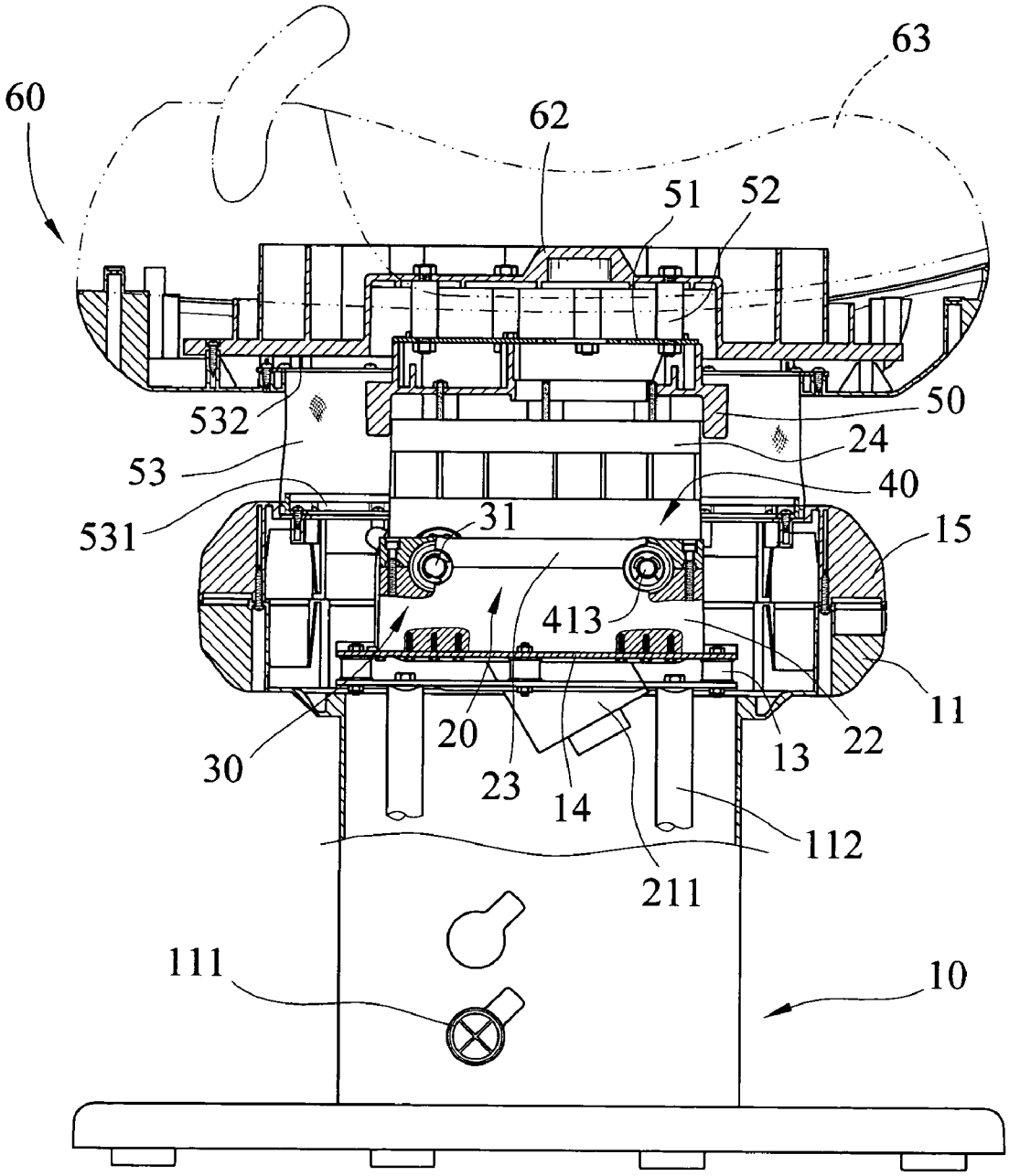
FIG. 5 is a cross sectional view of the balance training apparatus of the present invention.
Figure 6:
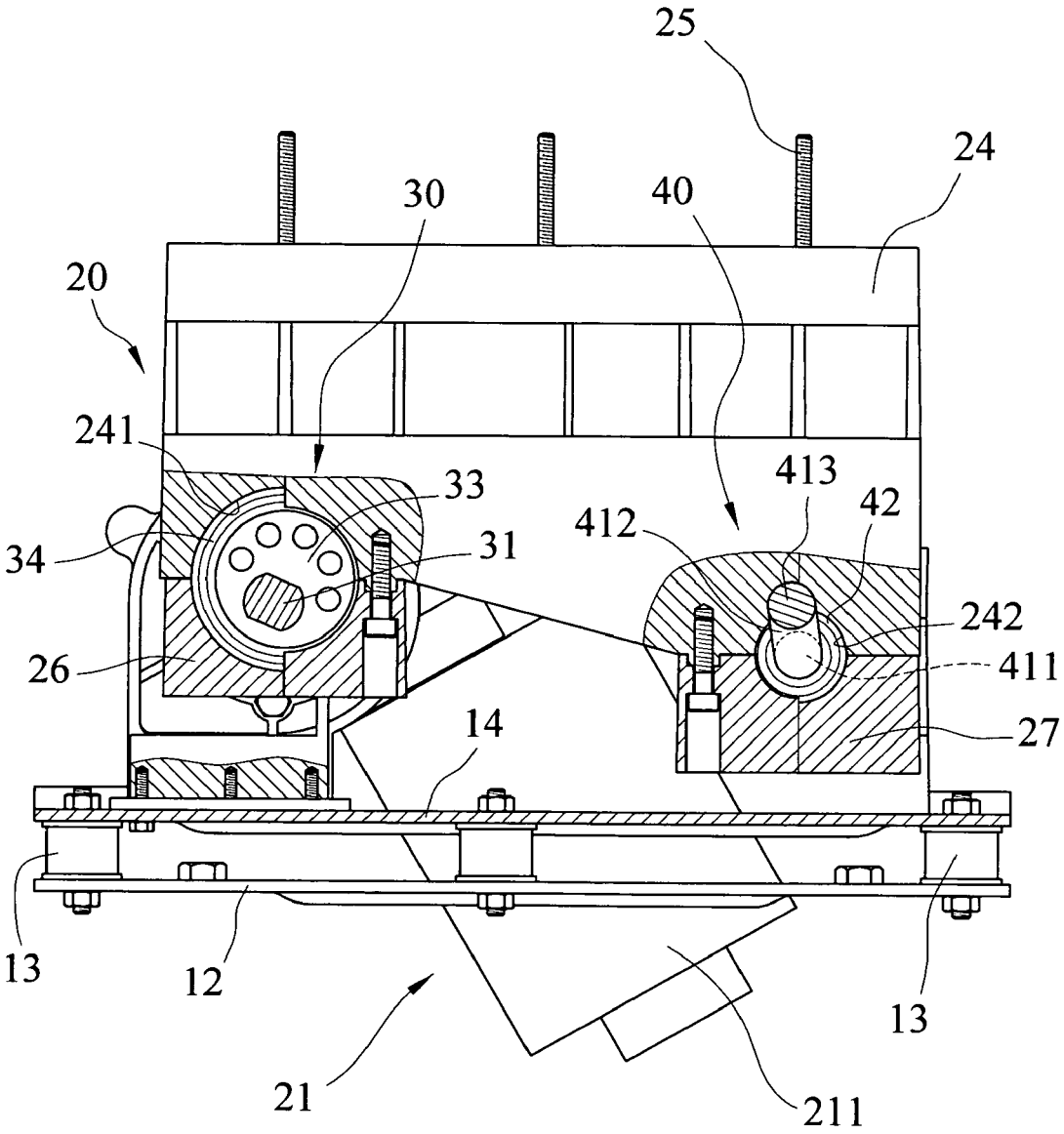
FIG. 6 is a cross sectional view of the driving device of the balance training apparatus of the present invention.

Referring to FIGS. 1 to 6, the balance training apparatus of the present invention comprises a base 10 connected to a base board 14 which has two first blocks 22 connected on two side of a top thereof and two second blocks 23 are respectively mounted on the two first blocks 22. The first blocks 21 each have two semi-circular notches 221 defined in a top thereof and second blocks 23 each have two semi-circular notches 231 defined in an underside thereof. The semi-circular notches 221 and the semi-circular notches 231 are cooperated to form two circular spaces. As shown in FIG. 3, the base 10 includes a lower portion 11 and an upper portion 15 which is mounted on the lower portion 11. A plurality of connection tubes 112 extend from the lower portion 11 and an intermediate board 12 is connected to the connection tubes 112. A plurality of flexible members 13 are connected to the intermediate board 12 and the driving device 20 is connected to the flexible members 13. The driving device 20 extends through a central hole of the upper portion 15. Two footrests 111 extend from two sides of the upright portion of the lower portion 11.

A driving device 20 has a power source 21, a swing portion 24, an active portion 30 driven by the power source 21 and a passive portion 40 which is driven by the active portion 30. The power source 21 includes a motor 211, a gear reduction member 212 which is connected to the motor 211 and a first axle 31 of the active portion 30.

A connection device 50 is connected on a top of the driving device 20 and a connection board 51 is connected on a top of the connection device 50 by a plurality of connection members 52. Each connection member 52 has two threaded ends which are connected to the connection board 51 and a seat portion 60. The seat portion 60 is connected to the swing portion 24 which has two first recesses 241 and two second recesses 242 defined in two sides of an underside thereof. The first recesses 241 of the swing portion 24 are located higher than the two second recesses 242 of the swing portion 24 so that the swing portion 24 is positioned at an angle. A plurality of threaded rods 25 extend from a top of the swing portion 24 so as to be connected to the connection device 50.

Two first support frames 26 each have a third recess 261 which is located corresponding to respective one of the two first recesses 241. Two second support frames 27 each have a fourth recess 271 which is located corresponding to respective one of the two second recesses 242. The active portion 30 and the passive portion 40 are respectively engaged with the first and second support frames 26, 27.

The active portion 30 has a first axle 31 which extends through two respective through holes 331 of two eccentric wheels 33 and is driven by the power source 21. The two eccentric wheels 33 are engaged with the spaces enclosed by the first and second recesses 241, 242 and the third and fourth recesses 261, 271, so that the active portion 30 is moved about the first axle 31 in an oval path.

Two bearings 34 are connected to the first axle 31 which is rotatably supported by two support members 32. Two bearings are mounted to two ends of the first axle 31 and engaged with respective circular spaces enclosed by the semi-circular notches 221, 231 in the first and second blocks 22, 23. Two bearings are mounted to the two distal ends 413 of the second axle 41 and are engaged with the respective circular spaces enclosed by semi-circular notches 221, 231 in the first and second blocks 22, 23.

The passive portion 40 has a second axle 41 which includes a straight section 411 and two bearing 42 are mounted to the straight section 411 so that the straight section 411 is rotatably engaged between the first and second recesses 241, 242 of the swing portion 24 and the third and fourth recesses 261, 271 of the first and second support frames 26, 27. Two crank portions 412 are connected to two ends of the straight section 411 of the second axle 41 and two distal ends 413 of the two crank portions 412 are rotatably engaged with the first and second blocks 22, 23.

The seat portion 60 includes a hollow lower portion 61, a main frame 62 fixed to the lower portion 61, and a top portion 63 which is fixed to the main frame 62, a bellow member 53 has an upper fixing collar 532 and a lower fixing collar 531. The lower fixing collar 531 is connected to the upper portion 15 of the base 10 and upper fixing collar 532 is fixed to the main frame 62 of the seat portion 60.

Figure 7:
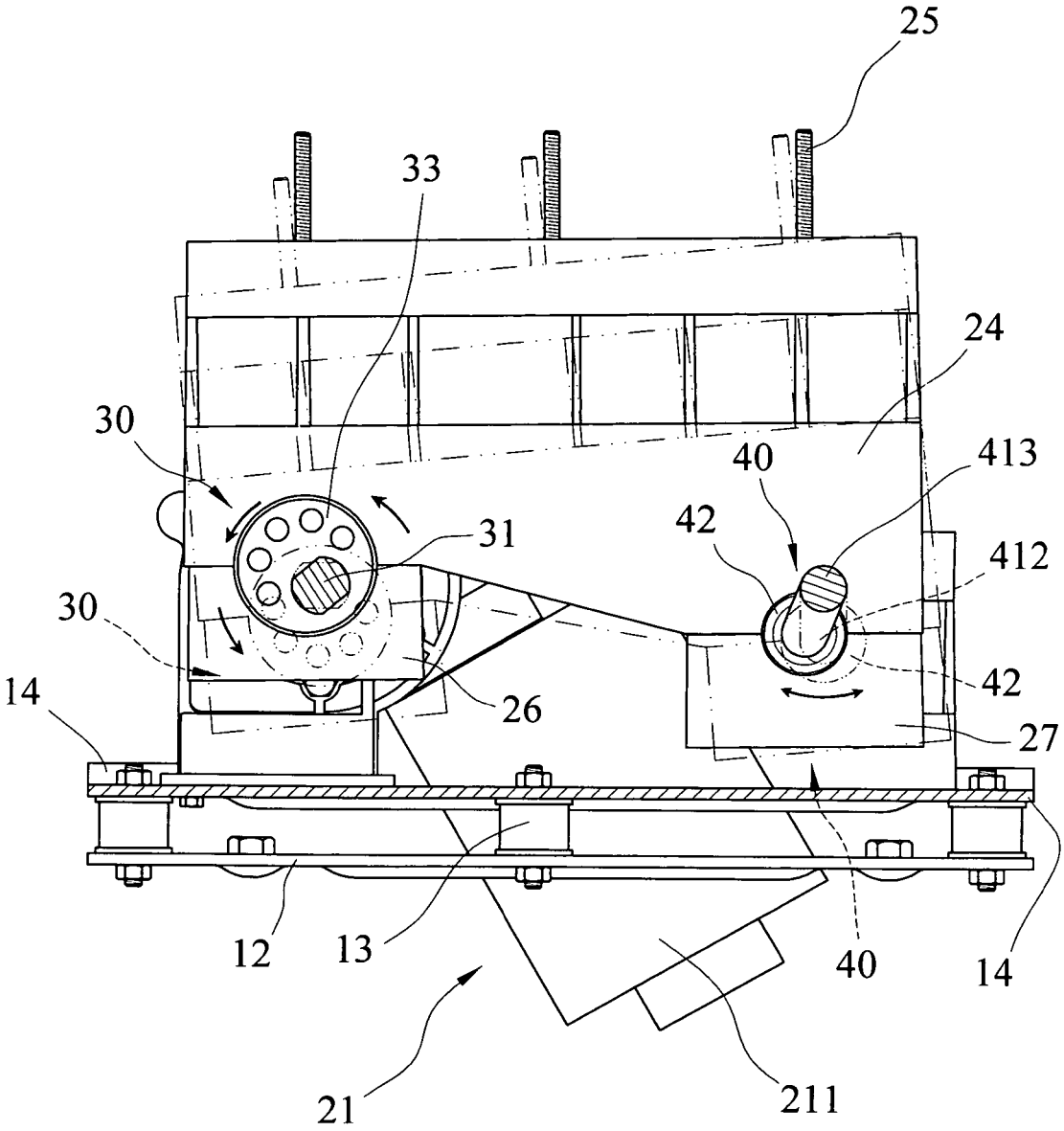
FIG. 7 shows that the swing portion swings when the driving device is activated.

Referring to FIG. 7, when the driving device source 20 is activated, the first axle 31 of the active portion 30 rotates and the swing portion 24 is moved up and down, and back and forth by the two eccentric wheels 33. The movement of the swing portion 24 drives the passive portion 40 so that the straight section 411 together with the bearings 42 and the crank portions 412 move back and forth. Therefore, the movement of the swing portion 24 transfers to the main frame 62 via the connection device 50 and the connection board 51 and the connection device 50. The user sits on the seat portion 60 moves like riding a horse.

The connection members 52 and the flexible members 13 can be deformed and absorb socks from the driving device 20 so that the user feel comfortable during using the balance training apparatus.

Figure 8:
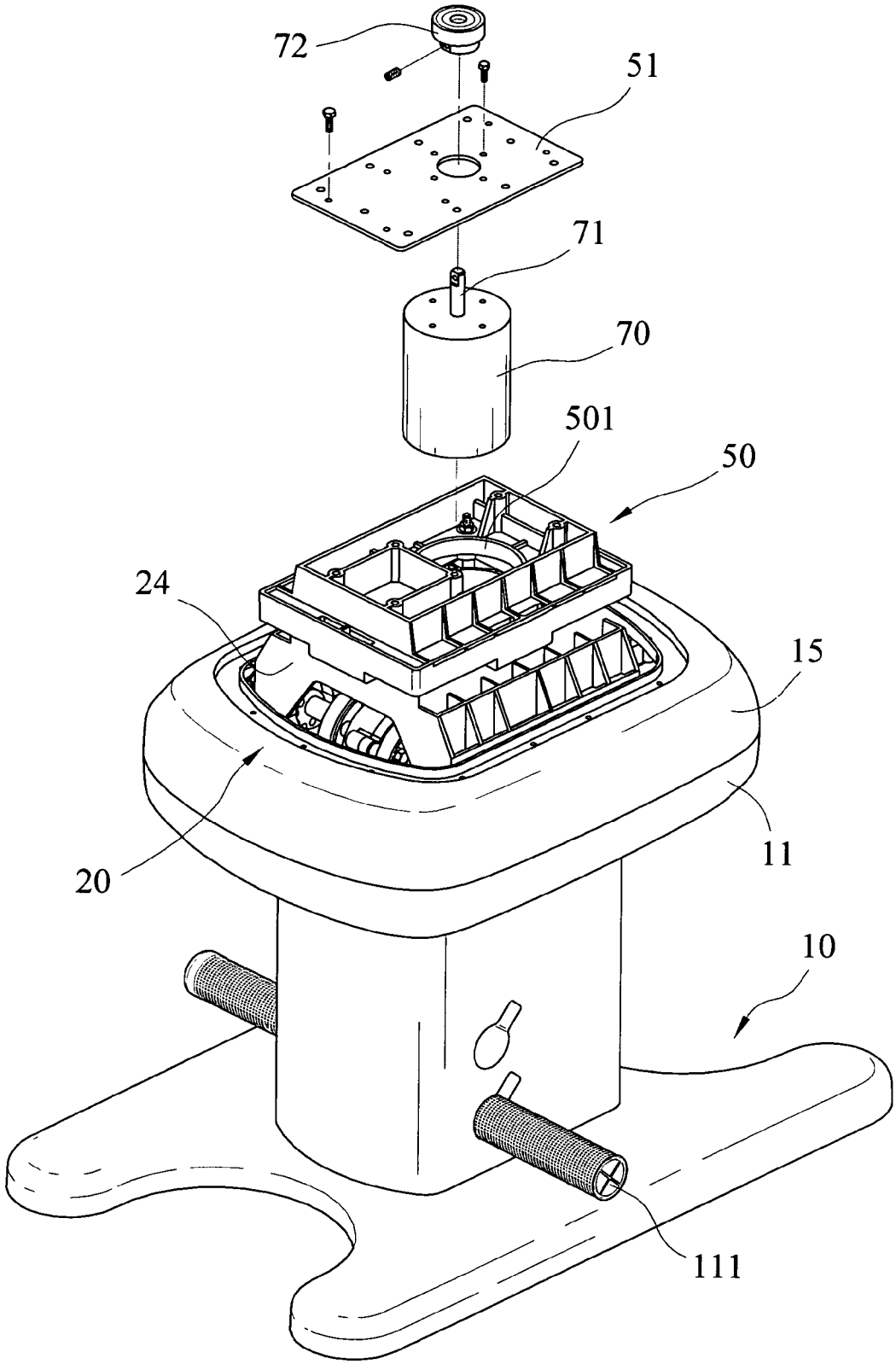
FIG. 8 is an exploded view to show another embodiment of the present invention.
Figure 9:
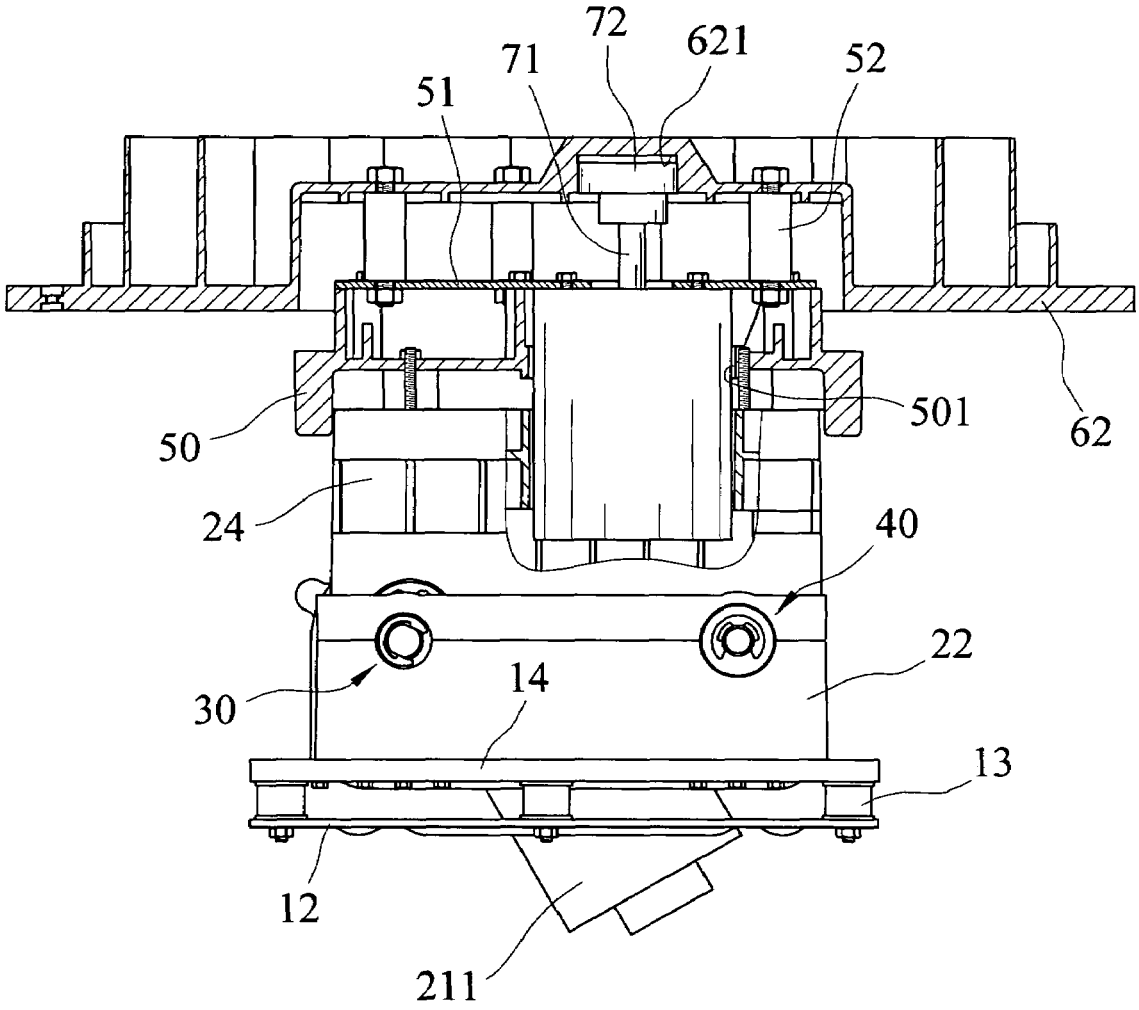
FIG. 9 is a cross sectional view of the embodiment in FIG. 8.

As shown in FIGS. 8 and 9, the mechanism disclosed in the present invention can also be used for vibration exerciser, wherein the connection device 50 has a hole 501 in which a vibration motor 70 is received. The vibration motor 70 is fixed to the connection board 51. An eccentric wheel 72 is connected to an output shaft 71 of the vibration motor 70 and is rotatably located in a recess 621 in an underside of the seat portion 60. When the vibration motor 70 is activated, the eccentric wheel 72 is rotated so as to make the seat portion 60 to move back and forth in an oval path. The user can choose different functions such as use both of the vibration motor 70 while enjoying the horse-riding function, or use only the vibration motor 70.

While we have shown and described the embodiment in accordance with the present invention, it should be clear to those skilled in the art that further embodiments may be made without departing from the scope of the present invention.

What is claimed is:

1. A balance training apparatus comprising:

a base connected to a base board which has two first blocks connected on two side of a top thereof and two second blocks respectively mounted on the two first blocks;

a driving device having a power source, a swing portion, an active portion driven by the power source and a passive portion which is driven by the active portion;

a seat portion connected to the swing portion which has two first recesses and two second recesses, two first support frames each having a third recess which is located corresponding to respective one of the two first recesses, two second support frames each having a fourth recess which is located corresponding to respective one of the two second recesses, the active portion and the passive portion respectively engaged with the first and second support frames;

the active portion having a first axle which extends through two respective through holes of two eccentric wheels and is driven by the power source, the two eccentric wheels engaged with spaces enclosed by the first and second recesses and the third and fourth recesses, the active portion being moved about the first axle in an oval path;

the passive portion having a second axle which includes a straight section and two bearing are mounted to the straight section so that the straight section is rotatably engaged between the first and second recesses of the swing portion and the third and fourth recesses of the first and second support frames, two crank portions connected to two ends of the straight section of the second axle and two distal ends of the two crank portions rotatably engaged with the first and second blocks.

2. The apparatus as claimed in claim 1, wherein the base includes a lower portion and an upper portion which is mounted on the lower portion, a plurality of connection tubes extend from the lower portion and an intermediate board is connected to the connection tubes, a plurality of flexible members are connected to the intermediate board and the driving device is connected to the flexible members, the driving device extends through a central hole of the upper portion.

3. The apparatus as claimed in claim 1, wherein a connection device is connected on a top of the driving device and a connection board is connected on a top of the connection device by a plurality of connection members, each connection member has two threaded ends which are connected to the connection board and the seat portion.

4. The apparatus as claimed in claim 1, wherein the seat portion includes a hollow lower portion, a main frame fixed to the lower portion, and a top portion which is fixed to the main frame, a bellow member has an upper fixing collar and a lower fixing collar, wherein the lower fixing collar is connected to the upper portion of the base and upper fixing collar is fixed to the main frame of the seat portion.

5. The apparatus as claimed in claim 1, wherein the power source includes a motor, a gear reduction member which is connected to the motor and the first axle.

6. The apparatus as claimed in claim 3, wherein the first recesses of the swing portion is located higher than the two second recesses of the swing portion, a plurality of threaded rods extend from a top of the swing portion so as to be connected to the connection device.

7. The apparatus as claimed in claim 3, wherein two bearings are connected to the first axle which is rotatably supported by two support members, two bearings are mounted to two ends of the first axle and engaged with respective circular spaces enclosed by semi-circular notches in the first and second blocks, two bearings are mounted to the two distal ends of the second axle and are engaged with the respective circular spaces enclosed by semi-circular notches in the first and second blocks.

8. The apparatus as claimed in claim 1, wherein the base includes a vibration motor and an eccentric wheel is connected to an output shaft of the vibration motor, the eccentric wheel is rotatably located in an recess in an underside of the seat portion.

9. The apparatus as claimed in claim 8, wherein a connection device has a hole in which the vibration motor is received, the vibration motor is fixed to the a connection board.

* * * * *